US006672094B1

(12) United States Patent
Carden et al.

(10) Patent No.: US 6,672,094 B1
(45) Date of Patent: Jan. 6, 2004

(54) PRESSURE RELIEF SYSTEM FOR A REFRIGERATOR

(75) Inventors: Michael Scot Carden, Aledo, IL (US); John Phillip Myers, Galesburg, IL (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/385,502

(22) Filed: Mar. 12, 2003

(51) Int. Cl.[7] ..... F25D 23/06
(52) U.S. Cl. ..... 62/273; 62/409; 62/410
(58) Field of Search ..... 62/273, 409, 410, 62/189; 454/195

(56) References Cited

U.S. PATENT DOCUMENTS

| | | | | |
|---|---|---|---|---|
| 2,139,991 A | | 12/1938 | Wingard | |
| 2,810,493 A | | 10/1957 | Eichhorn et al. | |
| 3,167,931 A | | 2/1965 | Bryson | |
| 3,376,711 A | | 4/1968 | Hagendoorn et al. | |
| 3,680,329 A | | 8/1972 | Burtis | |
| 3,813,896 A | | 6/1974 | Lebahn | |
| 3,826,106 A | * | 7/1974 | O'Hanlon et al. | 62/275 |
| 3,916,643 A | * | 11/1975 | Brown | 62/410 |
| 3,952,542 A | | 4/1976 | Berkowitz | |
| 4,257,445 A | | 3/1981 | Cook et al. | |
| 4,569,208 A | | 2/1986 | Villa | |
| 4,662,270 A | | 5/1987 | Fiddler et al. | |
| 4,759,198 A | | 7/1988 | Yamada | |
| 5,271,240 A | * | 12/1993 | Detrick et al. | 62/268 |
| 5,557,942 A | * | 9/1996 | Kim et al. | 62/288 |
| 5,573,323 A | | 11/1996 | Kim et al. | |
| 5,623,958 A | | 4/1997 | Bumpers | |
| 5,836,170 A | | 11/1998 | Perkins et al. | |
| 6,176,776 B1 | | 1/2001 | Finkelstein et al. | |
| 6,374,620 B1 | * | 4/2002 | Markey | 62/89 |

FOREIGN PATENT DOCUMENTS

| | | | |
|---|---|---|---|
| DE | 19532182 | | 3/1997 |
| JP | 363196250 A | * | 8/1988 |
| JP | 401291088 | | 11/1989 |
| JP | 407190603 A | * | 7/1995 |
| JP | 408233440 | | 9/1996 |

* cited by examiner

*Primary Examiner*—William E. Tapolcai
*Assistant Examiner*—Mohammad M. Ali
(74) *Attorney, Agent, or Firm*—Diederiks & Whitelaw, PLC

(57) ABSTRACT

To allow for easier opening of a refrigerator door, a pressure relief system is provided to relieve a pressure differential or vacuum that develops due to operation and use of the refrigerator. The pressure relief system includes a check valve having an orifice with a flexible membrane. An insulation portion of the pressure relief valve, which is foamed into the cabinet, spans from the fresh food compartment to a top of the cabinet and directs air towards the rear cabinet liner for moisture condensing measures. The pressure relief assembly also includes an adapter which mounts to the cabinet top and provides a mounting surface for an air return assembly.

25 Claims, 4 Drawing Sheets

PRESSURE RELIEF SYSTEM FOR A REFRIGERATOR

BACKGROUND OF THE INVENTION

1. Field of the Invention

The present invention pertains to the art of refrigerators and, more particularly, to a system for equalizing pressures between inside and outside of a refrigerator.

2. Discussion of the Prior Art

In general, a refrigerator includes a first or freezer compartment for maintaining foodstuffs at or below freezing, and a second or fresh food compartment, in fluid communication with the freezer compartment, for maintaining foodstuffs in a temperature zone between ambient and freezing temperatures. A typical refrigerator includes a refrigeration system having a compressor, a condenser, a condenser fan, an evaporator coil, and an evaporator fan.

In operation, temperature sensors are provided within the refrigerator to measure internal temperatures of the appliance. When a door associated with either compartment is opened, the temperature within the respective compartment will rise. When the internal temperature of the refrigerator deviates from a predetermined temperature, the refrigeration system is caused to operate such that the temperature will return to a point below a consumer selected set-point. In order to return the compartment temperature to this point, the refrigeration system is activated.

A supplement to compressor operation is the addition of a damper located between the evaporator and the fresh food compartment. Operation of the damper is controlled such that cool air is permitted to flow from the evaporator to the fresh food compartment. In some arrangements, a fan is mounted adjacent to the evaporator to aid in establishing the air flow. Accordingly, if the temperature of the fresh food compartment rises above the set-point, the damper is operated to allow the passage of cooling air from the evaporator compartment to the fresh food compartment.

In any case, due to operation of the refrigeration system or otherwise cooling of a refrigerator compartment, a temperature gradient develops between inside and outside of the refrigerator. As doors are opened and closed on a refrigerator in operation, especially in a warm, humid environment, a pressure differential can be created from outside the refrigerator to inside. This pressure differential results in the doors being hard to open. Certainly, it is desirable to maintain a fairly consistent opening force requirement. To this end, there exists a need in the art for a system to equalize pressures inside and outside a refrigerator in order to control the level of force needed to open a door of the refrigerator. Although pressure equalizing systems have been proposed in the art, the need still exists for a reliable, cost efficient, pressure relief system, particularly one which regulates a pressure controlling air flow in an effective manner.

SUMMARY OF THE INVENTION

The present invention is directed to incorporating a pressure relief system in a refrigerator in order to allow for easier opening of a door of the refrigerator. The system serves to relieve an excessive pressure differential or vacuum condition that develops due to warm air entering the refrigerator and then cooling. In accordance with a preferred embodiment of the invention, the pressure relief system includes a check valve having an orifice with a flexible membrane attached thereto. An insulation portion of the pressure relief valve, which is foamed into the cabinet, spans from the fresh food compartment to the cabinet top. The pressure relief valve includes a portion in the fresh food compartment that directs air towards the rear cabinet liner for moisture condensing measures. The valve also includes an adapter which is secured to the cabinet top and provides a mounting surface for an air return assembly. The air return assembly is an injection molded housing which includes an opening, preferably including a flexible membrane.

In essence, in an effort to relieve the pressure differential, the pressure relief assembly defines a duct which serves as a pathway for pressure relief from one chamber of the refrigerator to the surrounding environment. By incorporating a check valve arrangement, the pressure relief function is performed automatically as needed.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
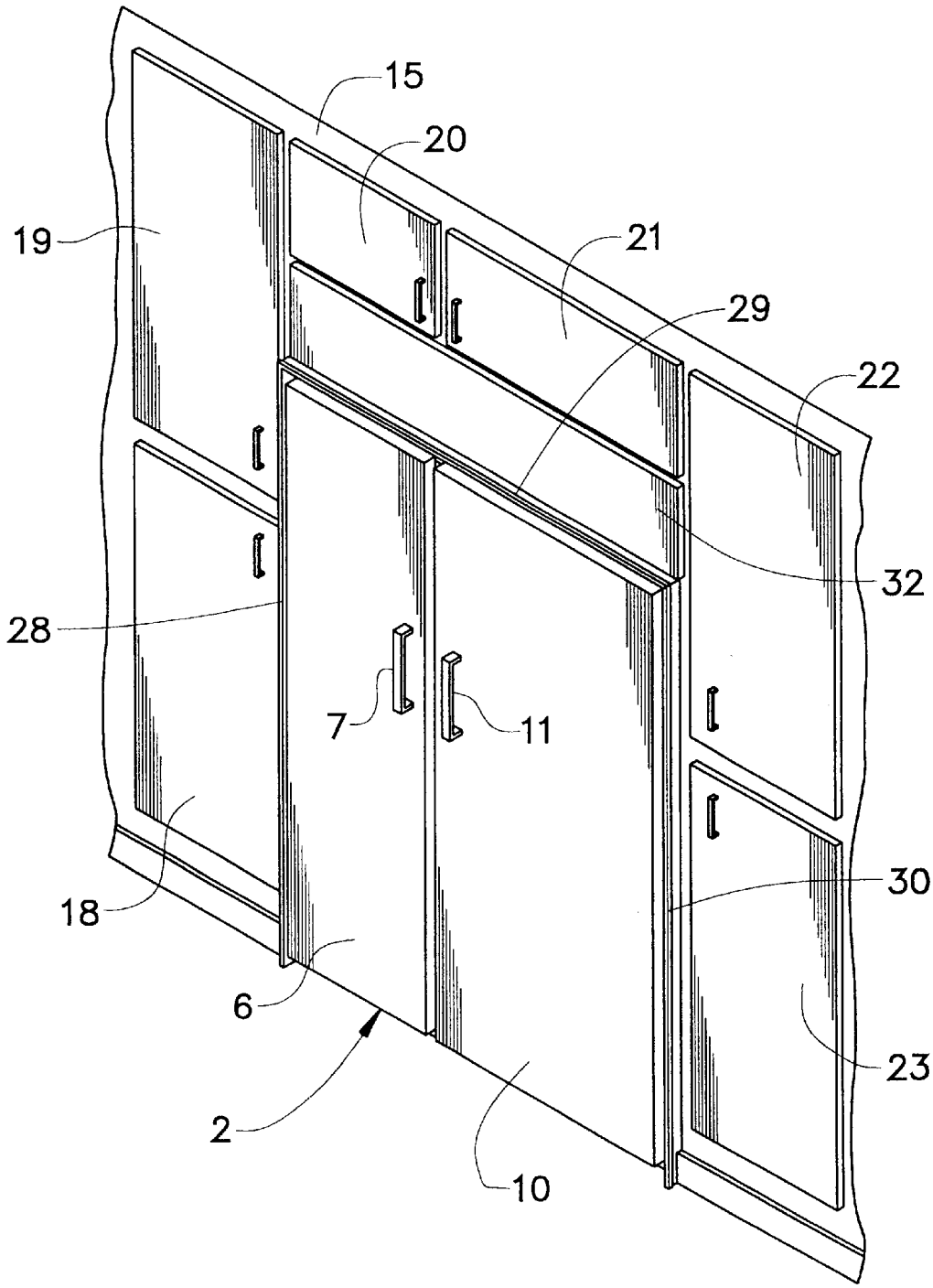
FIG. 1 is a perspective view of a refrigerator incorporating the pressure relief system of the invention.

With initial reference to FIG. 1, a refrigerator constructed in accordance with the present invention is generally shown at 2. Refrigerator 2 is shown to include a freezer door 6 having an associated handle 7 and a fresh food door 10 having an associated handle 11. In the embodiment shown, refrigerator 2 is of the recessed type such that, essentially, only freezer and fresh food doors 6 and 10 project forward of a wall 15. The remainder of refrigerator 2 is recessed within wall 15 in a manner similar to a plurality of surrounding cabinets generally indicated at 18–23. Refrigerator 2 also includes a plurality of peripheral trim pieces 28–30 to blend refrigerator 2 with cabinets 18–23. One preferred embodiment employs trim pieces 28–30 as set forth in U.S. Patent Application entitled "Fastening System for Appliance Cabinet Assembly" is filed on even date herewith and which is incorporated herein by reference. Finally, as will be described more fully below, refrigerator 2 is preferably designed with main components of a refrigeration system positioned behind an access panel 32 arranged directly above trim piece 29.

Figure 2:
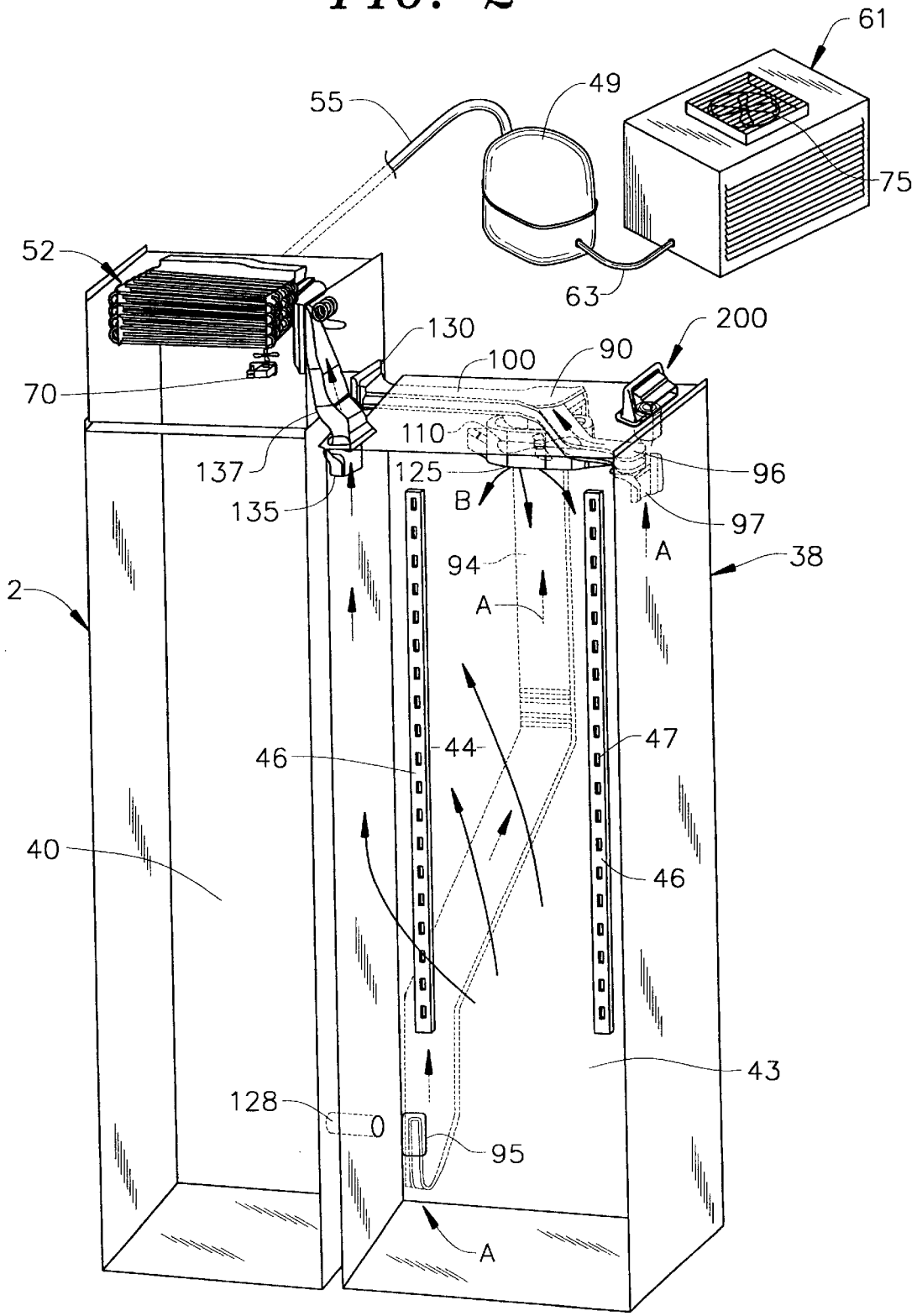
FIG. 2 is a schematic view showing the various components of is the refrigerator and the pressure relief system in accordance with a preferred embodiment of the present invention.

As shown in FIG. 2, refrigerator 2 includes a cabinet shell 38 defining a freezer compartment 40 and a fresh food compartment 43. For details of the overall construction of cabinet shell 38, reference is made to U.S. Patent Application entitled "Fastening System for Appliance Cabinet Assembly" filed on even date herewith and incorporated herein by reference. Shown arranged on a rear wall 44 of fresh food compartment 43 are a plurality of elongated metal shelf rails 46. Each shelf rail 46 is provided with a plurality of shelf support points, preferably in the form of slots 47, adapted to accommodate a plurality of vertically adjustable, cantilevered shelves (not shown) in a manner known in the art. Since the structure of shelves can vary and is not considered part of the present invention, the shelves have not been depicted for the sake of clarity of the drawings and will not be discussed further here.

Preferably mounted behind access panel 32 are components of the refrigeration system employed for refrigerator 2. More specifically, the refrigeration system includes a variable speed compressor 49 which is operatively connected to both an evaporator 52 through conduit 55, and a condenser 61 through conduit 63. Arranged adjacent to evaporator 52 is a variable speed evaporator fan 70 adapted to provide a variable airflow to evaporator 52. Similarly, arranged adjacent to condenser 61 is a condenser fan 75 adapted to provide an airflow across condenser 61.

In addition to the aforementioned components, mounted to an upper portion of fresh food compartment 43 is an air manifold 90 for use in directing a cooling airflow through fresh food compartment 43 of refrigerator 2. More specifically, a first recirculation duct 94 having an inlet 95 exposed in a lower portion of fresh food compartment 43, a second recirculation duct 96 having an inlet 97 exposed at an upper portion of fresh food compartment 43, and an intake duct 100 establishing an air path for a flow of fresh cooling air from freezer compartment 40 into manifold 90. Arranged in fluid communication with air manifold 90 is a variable speed fresh food stirring fan 110. Stirring fan 110 is adapted to receive a combined flow of air from recirculation ducts 94 and 95, as well as intake duct 100, and to disperse the combined flow of air into the fresh food compartment 43. With this arrangement, stirring fan 110 draws in a flow of air, which is generally indicated by arrows A, through inlets 95 and 97 of ducts 94 and 96, and intake duct 100, while subsequently exhausting the combined flow of cooling air, represented by arrow B, through outlet 125. Most preferably, outlet 125 directs the air flow in various directions in order to generate a desired flow pattern based on the particular configuration of fresh food compartment 43 and any additional structure provided therein.

The exact positioning of inlets 95 and 97 also depend on the particular structure provided. In one preferred embodiment, inlet 95 of duct 94 is located at a point behind at least one food storage bin (not shown) arranged in a bottom portion of fresh food compartment 43. The air flow past the storage bin is provided to aid in maintaining freshness levels of food contained therein. For this purpose, an additional passage leading from freezer compartment 40 into fresh food compartment 43 can be provided as generally indicated at 128. While not part of the present invention, the details of the storage bin are described in U.S. Pat. No. 6,170,276 which is hereby incorporated by reference.

In order to regulate the amount of cooling air drawn in from freezer compartment 40, a variable position damper 130 is provided either at an entrance to or within intake duct 100. As will be discussed more fully below, when the cooling demand within fresh food compartment 43 rises, variable position damper 130 opens to allow cooling air to flow from freezer compartment 40 to fresh food compartment 43 and, more specifically, into intake duct 100 to manifold 90 and stirring fan 110. A flow of air to be further cooled at evaporator 52 is lead into an intake 135 of a return duct 137. In the embodiment shown, return duct 137 is preferably located in the upper portion of fresh food compartment 43.

This overall refrigeration system synergistically operates to both maintain the temperature within fresh food compartment 43 at a substantially uniform temperature preferably established by an operator and minimizes stratification of the temperature in fresh food compartment 43. The particular manner in which the refrigeration system described above operates does not form part of the present invention. Instead, the operation of the refrigeration system is covered in U.S. Patent Applications entitled "Variable Speed Refrigeration System" and "Temperature Control System for a Refrigerated Compartment" filed on even date herewith and incorporated herein by reference.

The above description of the refrigerator 2 has basically been provided for the sake of completeness. The present invention is actually directed to the inclusion of a pressure relief system, generally indicated at 200 in this figure, in refrigerator 2. In general, pressure relief system 200 functions to equalize a pressure differential developing between both freezer and fresh food compartments 40 and 43 and the surrounding environment. That is, due to operation of the refrigeration system, air within refrigerator 2 will be cooled which can create a vacuum, particularly within fresh food compartment 43. For instance, when door 6 is opened, warm air enters refrigerator 2. Thereafter, upon attempting to open fresh food door 10, a created vacuum can increase the force needed to open door 10. The present invention addresses this potential problem as will be detailed fully below with particular reference to FIGS. 3 and 4.

Figure 4:
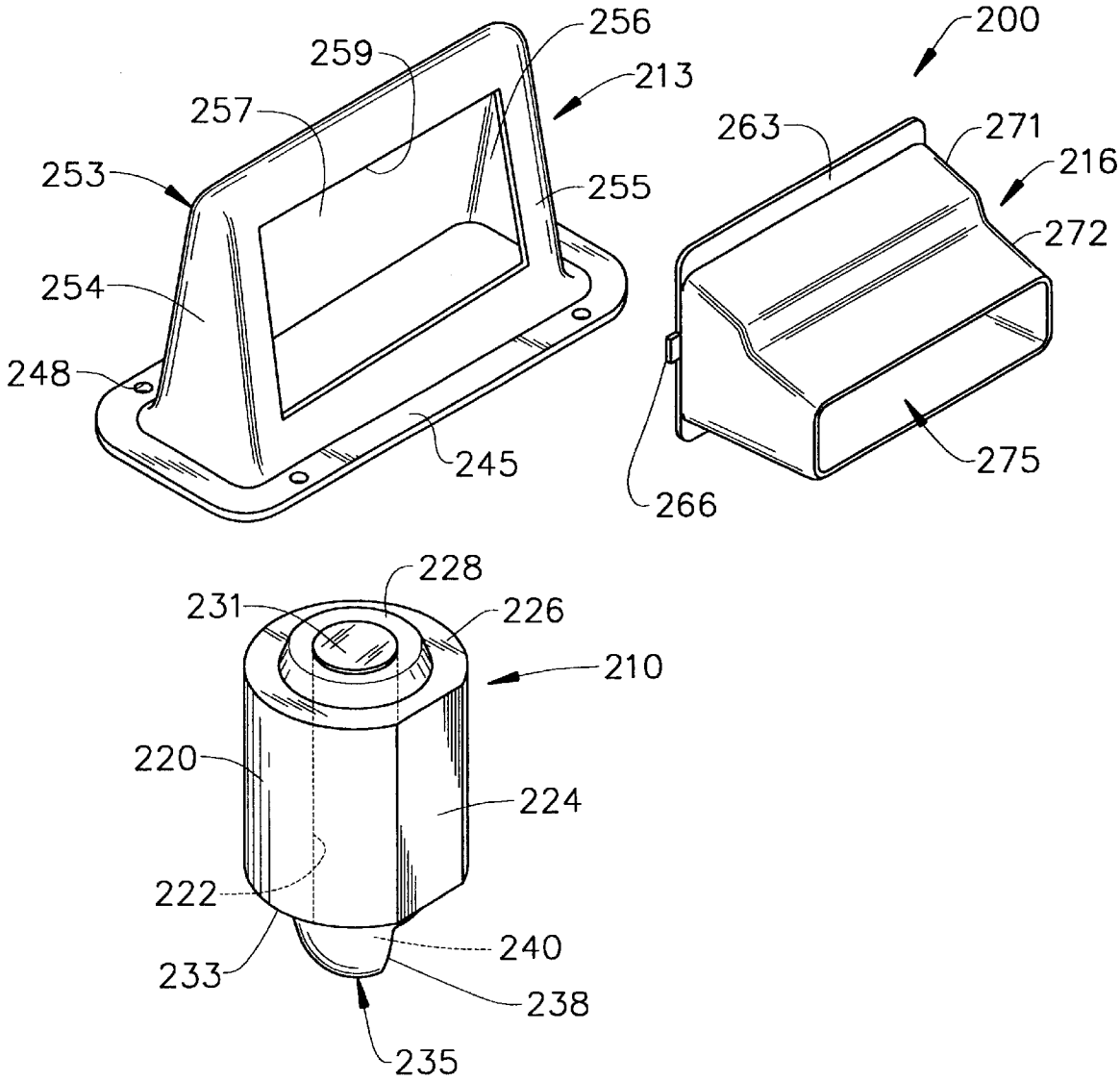
FIG. 4 is an exploded view of the main components of the pressure relief system according to a preferred embodiment of the invention.

In accordance with the most preferred embodiment of the invention, pressure relief system 200 includes a pressure relief valve 210, a mounting adapter 213 and an air return housing 216. More specifically, as best shown in FIG. 4, pressure relief valve 210 includes a main body portion 220 provided with a central bore 222 and a peripheral flat 224. At an upper portion 226 of main body portion 220 is arranged a truncated, conical port 228 leading into central bore 222. Preferably, port 228 is formed with a flexible membrane 231 that defines a check valve. More specifically, flexible membrane 231 is connected about a significant portion of central bore 222 to automatically open an air passage defined by central bore 222 when a differential pressure develops across pressure relief valve 210 as will be discussed more fully below. At a lower portion 233 of pressure relief valve 210 is defined an air director 235 including an arcuate deflector 238 having an associated opening 240 which leads into central bore 222.

As shown, mounting adapter 213 includes a peripheral flange 245 formed with a plurality of mounting apertures 248. More particularly, peripheral flange 245 extends about an adapter housing 253. Adapter housing 253 is preferably integrally molded of plastic and includes side wall portions 254–257, with side walls 254 and 256 being generally triangular in shape so as to taper upwardly. Side wall 255 is formed with an enlarged, generally rectangular opening 259, while a bottom 260 of adapter housing 253 is open.

Air return housing 216 includes a peripheral plate 263 which has extending therefrom opposing side tabs, one of which is indicated at 266. Air return housing 216 is actually defined by an enlarged body section 271 which extends from plate 263 and leads to a tapered body section 272. Preferably, air return housing 216 is also integrally molded of plastic and defines an internal passage generally indicated at 275.

Figure 3:
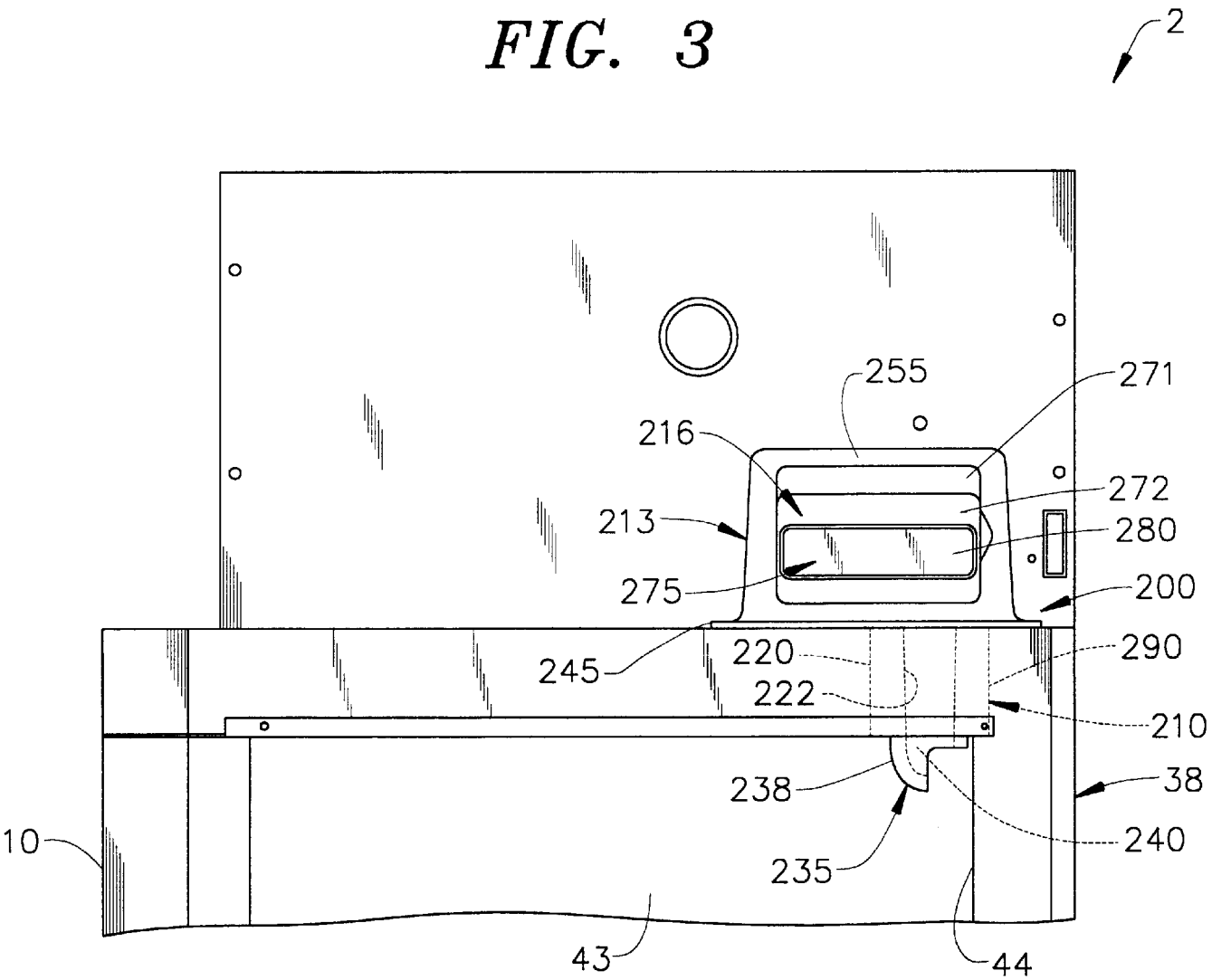
FIG. 3 is a side view of the refrigerator with the pressure relief system of the invention.

Pressure relief system 200 is preferably mounted at an upper rear portion of fresh food compartment 43 of refrigerator 2. More specifically, through an upper right rear portion of fresh food compartment 43 and cabinet shell 38 is provided a passage 290 (see FIG. 3) within which main body portion 220 of pressure relief valve 210 is positioned prior to the injection of foam insulation for cabinet shell 38 such that pressure relief valve 210 is mounted in situ. Passage 290 is generally circular but includes a flat section (not shown) to align with peripheral flat 224 to assure proper positioning of air director 235. In any case, pressure relief valve 210 is fixed in position with truncated conical port 228 extending above cabinet shell 38 behind access panel 32, while arcuate deflector 238 is positioned in fresh food compartment 43. As shown in FIG. 3, arcuate deflector 238 is actually arranged with opening 240 being exposed to rear wall 44. On the other hand, mounting adapter 213 is secured to cabinet shell 38 with truncated conical port 28 leading to and sealing about opening 261. That is, peripheral flange 245 of mounting adapter 213 rests upon cabinet shell 38 and is secured thereto with mechanical fasteners (not shown) extending through apertures 248 and into cabinet shell 38. In addition, air return housing 216 is attached to mounting adapter 213, with tabs 266 extending behind side wall 255. Therefore, internal passage 275 is in fluid communication with bore 222 and preferably opens laterally of refrigerator 2.

With this arrangement, fresh food compartment 43 will be fluidly connected to the environment surrounding refrigerator 2, at least when check valve 231 is open. In accordance with the invention, check valve 231 will automatically open when the differential pressure between inside and outside of refrigerator 2 is greater than a sealing force associated with check valve 231. When this occurs, an equalization process will be performed. In this way, the force needed to open either of doors 6 or 10 will be maintained substantially constant. As indicated above, air director 235 opens toward rear wall 44 against a metal liner (not labeled) of fresh food compartment 43, which will generally be the warmest zone in refrigerator 2, for moisture condensation purposes. In addition, internal passage 275 of air return housing 216 is preferably provided with a flexible membrane 280, such as a MYLAR or a polymeric sheet, (see FIG. 3) adjacent opening 259 for filtering purposes. In any case, to relieve the pressure differential, pressure relief assembly 200 defines a duct which serves as a pathway for pressure relief from one chamber of refrigerator 2 to the surrounding environment. By incorporating check valve 231, the pressure relief function is performed automatically as needed.

Although described with reference to a preferred embodiment of the invention, it should be readily understood that various changes and/or modifications can be made to the invention without departing from the spirit thereof. For instance, although the most preferred form of the invention incorporates the structure and arrangement set forth above, it would be possible to incorporate other valve structure to perform the pressure equalization function and/or reposition pressure relief assembly 200. In any event, the invention is only intended to be limited by the scope of the following claims.

We claim:

1. A refrigerator comprising:

a cabinet shell including a fresh food compartment and a freezer compartment defined by at least one liner mounted within the cabinet shell;

a fresh food compartment door for selectively accessing the fresh food compartment;

a freezer compartment door for selectively accessing the freezer compartment;

a passage for fluidly interconnecting said fresh food compartment with said freezer compartment;

a refrigeration system for cooling both the freezer compartment and the fresh food compartment; and a pressure relief assembly for regulating a pressure differential between inside and outside the refrigerator, said pressure relief assembly including a pressure relief member having a main body portion provided with a bore extending there through, wherein the main body portion is mounted in situ between the cabinet shell and the fresh food compartment with a first end portion of the main body portion being exposed to outside the cabinet shell and a second end portion opening into the fresh food compartment, said pressure relief member including a check valve defined by a flexible membrane for automatically controlling a flow of air between inside and outside the refrigerator based on the pressure differential, said second end portion of the main body portion including an air director for controlling the flow of air into the fresh food compartment through the main body portion, wherein the air director includes an opening which directs the flow of air against a rear wall portion of the at least one liner.

2. A refrigerator comprising:

a cabinet shell including a fresh food compartment and a freezer compartment defined by at least one liner mounted within the cabinet shell;

a fresh food compartment door for selectively accessing the fresh food compartment;

a freezer compartment door for selectively accessing the freezer compartment;

a passage for fluidly interconnecting said fresh food compartment with said freezer compartment;

a refrigeration system for cooling both the freezer compartment and the fresh food compartment; and a pressure relief assembly for regulating a pressure differential between inside and outside the refrigerator, said pressure relief assembly including a pressure relief member having a main body portion provided with a bore extending there through, wherein the main body portion is mounted in situ between the cabinet shell and the fresh food compartment with a first end portion of the main body portion being exposed to outside the cabinet shell and a second end portion opening into the fresh food compartment, said pressure relief member including a check valve defined by a flexible membrane for automatically controlling a flow of air between inside and outside the refrigerator based on the pressure differential.

3. The refrigerator according to claim 2, wherein the second end portion of the main body portion includes an air director for controlling the flow of air into the fresh food compartment through the main body portion.

4. The refrigerator according to claim 3, wherein the air director includes an arcuate deflector having an opening which directs the flow of air to a rear wall of the fresh food compartment.

5. The refrigerator according to claim 2, wherein the first end portion is exposed atop the cabinet shell.

6. The refrigerator according to claim 5, wherein the first end portion is defined by a truncated conical port.

7. The refrigerator according to claim 2, wherein the pressure relief assembly further includes an air return housing mounted outside the cabinet shell, said air return housing including an internal passage in fluid communication with the bore provided in the main body portion of the pressure relief member.

8. The refrigerator according to claim 7, wherein the internal passage opens laterally of the refrigerator.

9. The refrigerator of claim 7, further comprising: a flexible membrane provided in the internal passage.

10. The refrigerator according to claim 7, wherein the air return housing includes an enlarged body section leading to a tapered body section.

11. The refrigerator according to claim 7, wherein the pressure relief assembly further includes a mounting adapter for interconnecting the air return housing to the pressure relief member.

12. The refrigerator according to claim 11, wherein the mounting adapter includes a peripheral flange provided with a plurality of mounting apertures for securing the mounting adapter atop the cabinet shell, over the bore of the main body portion.

13. The refrigerator according to claim 11, wherein the mounting adapter includes an upwardly tapering housing.

14. The refrigerator according to claim 11, wherein the mounting adapter includes an enlarged opening over which the air return housing is mounted.

15. The refrigerator according to claim 14, wherein the air return housing includes a plurality of tabs which extend into the enlarged opening for securing the air return housing to the mounting adapter.

16. A refrigerator comprising:

a cabinet shell including a fresh food compartment and a freezer compartment defined by at least one liner mounted within the cabinet shell;

a fresh food compartment door for selectively accessing the fresh food compartment;

a freezer compartment door for selectively accessing the freezer compartment;

a passage for fluidly interconnecting said fresh food compartment with said freezer compartment;

a refrigeration system for cooling both the freezer compartment and the fresh food compartment; and a pressure relief assembly for regulating a pressure differential between inside and outside the refrigerator, said pressure relief assembly including a pressure relief member having a main body portion provided with a bore extending there through with a first end portion of the main body portion being exposed to outside the cabinet shell and a second end portion opening into the fresh food compartment, said second end portion of the main body portion including an air director for controlling the flow of air into the fresh food compartment through the main body portion, wherein the air director includes an opening which directs the flow of air against a rear wall portion of the at least one liner.

17. The refrigerator according to claim 16, wherein the air director includes an arcuate deflector having an opening which directs the flow of air to the rear wall of the fresh food compartment.

18. The refrigerator according to claim 16, wherein the pressure relief assembly further includes an air return housing mounted outside the cabinet shell, said air return housing including an internal passage in fluid communication with the bore provided in the main body portion of the pressure relief member.

19. The refrigerator according to claim 18, wherein the internal passage opens laterally of the refrigerator.

20. The refrigerator of claim 18, further comprising: a flexible membrane provided in the internal passage.

21. The refrigerator according to claim 18, wherein the main body portion is mounted in situ between the cabinet shell and the fresh food compartment.

22. The refrigerator according to claim 21, wherein the first end portion is defined by a truncated conical port.

23. The refrigerator according to claim 18, wherein the pressure relief assembly further includes a mounting adapter for interconnecting the air return housing to the pressure relief member.

24. The refrigerator according to claim 23, wherein said pressure relief member includes a check valve for automatically controlling a flow of air between inside and outside the refrigerator based on the pressure differential.

25. The refrigerator according to claim 24, wherein the check valve constitutes a flexible membrane.

* * * * *